United States Patent [19]

Barthlome

[11] 4,089,004

[45] May 9, 1978

[54] COLLAPSIBLE CORRUGATED HORN ANTENNA

[75] Inventor: Donald E. Barthlome, Hampton, Va.

[73] Assignee: The United States of America as represented by the Administrator of the National Aeronautics and Space Administration, Washington, D.C.

[21] Appl. No.: 799,025

[22] Filed: May 20, 1977

[51] Int. Cl.[2] ..... H01Q 13/02

[52] U.S. Cl. ..... 343/786

[58] Field of Search ..... 343/786, 880, 895

[56] References Cited

U.S. PATENT DOCUMENTS

| | | | |
|---|---|---|---|
| 3,836,979 | 9/1974 | Kurland et al. | 343/895 |
| 3,949,406 | 4/1976 | Yuard | 343/786 |

*Primary Examiner*—Eli Lieberman

*Attorney, Agent, or Firm*—William H. King; John R. Manning; Howard J. Osborn

[57] ABSTRACT

This invention is a corrugated horn antenna that is readily collapsible while not in use. A plurality of different sized annular metal rings are arranged in a sequence such that each ring is larger than the one that precedes it in the sequence. A plurality of thin flexible electrically conductive members attach successive metal rings together physically and connect them together electrically. Each flexible conductive member is attached to make electrical contact between the outside surface of a metal ring and the inside surface of an adjacent metal ring in the sequence.

8 Claims, 5 Drawing Figures

COLLAPSIBLE CORRUGATED HORN ANTENNA

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

The invention relates generally to a corrugated horn antenna and more specifically concerns a corrugated horn antenna that is lightweight and readily collapsible.

Oftentimes, when a corrugated horn antenna is not in use, it is desirable to have the antenna readily collapsible for shipping or storage. In the past there has not been available a collapsible corrugated horn antenna without first disassembling the antenna.

It is therefore the primary purpose of this invention to provide a corrugated horn antenna that is readily collapsible without disassembling the antenna.

Another object of this invention is to provide a collapsible corrugated horn antenna that has a high collapse ratio (ratio of of extended length to collapsed length).

A further object of this invention is to provide a lightweight collapsible horn antenna.

Other objects and advantages of this invention will become apparent hereinafter in the specification and drawings.

SUMMARY OF THE INVENTION

The invention consists essentially of several different sized flat thin rigid annular metal rings arranged in a sequence such that the first ring in the sequence is the smallest and all other rings are larger than the one that precedes it in the sequence. Each adjacent pair of rings in the sequence are attached together physically and connected together electrically by a thin flexible sheet of an electrically conductive material such as, for example, an aluminum mylar laminate. The flexible sheet of electrically conductive material is attached to make contact between the outside surface of one of the metal rings and inside side surface of the succeeding metal ring in the sequence. Consequently, when the annular metal rings are moved away from each other a corrugated horn antenna is formed and when the annular metal rings are stacked the antenna is in its collapsed state ready for shipment or storage.

In an alternate embodiment of the invention the annular rings are in the shape of a frustum of a cone and each of the flexible sheets of electrically conductive material is attached to make contact between the inside surface of one of the metal rings and the outside surface of the succeeding metal ring in the sequence.

DETAILED DESCRIPTION OF THE INVENTION

Figure 1:
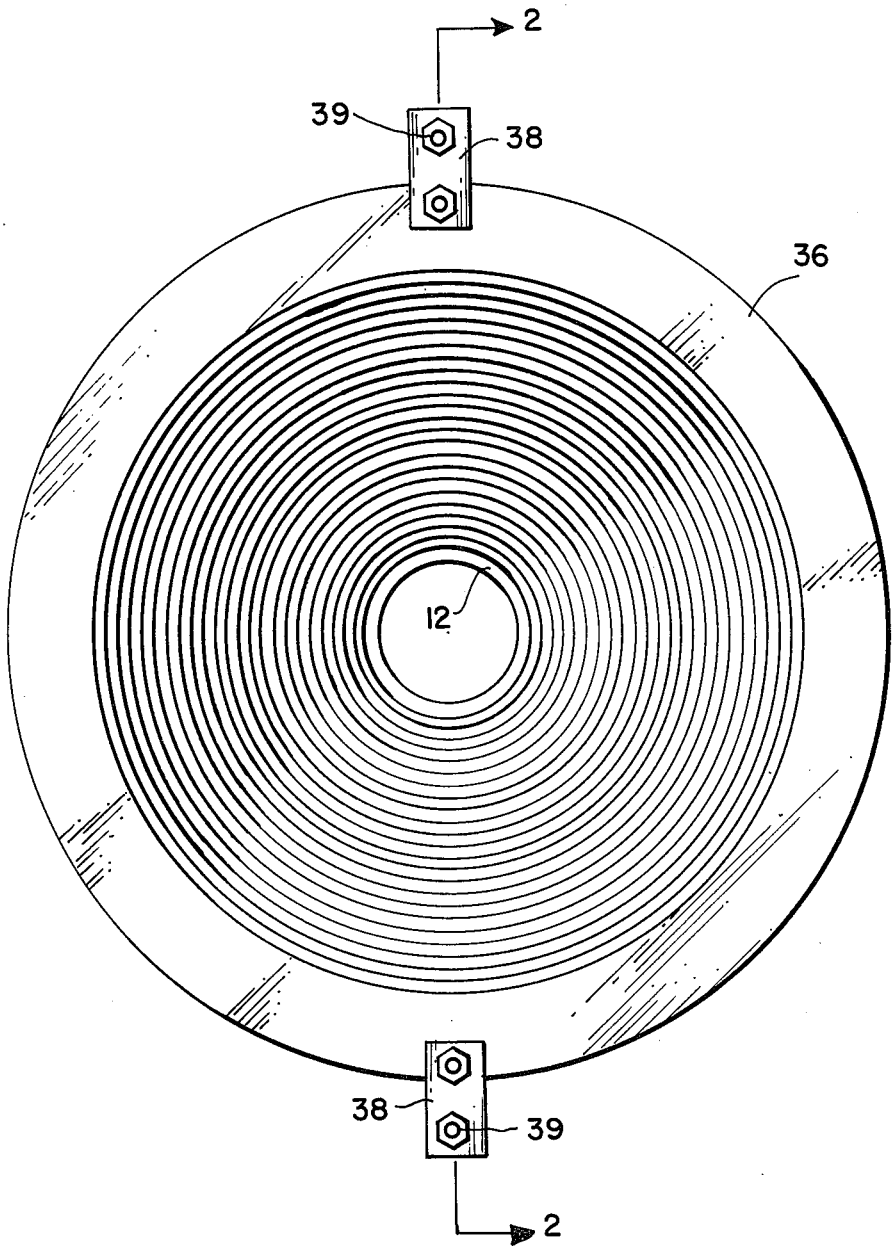
FIG. 1 is a view looking into the antenna that constitutes the invention when the antenna is extended for use.
Figure 2:
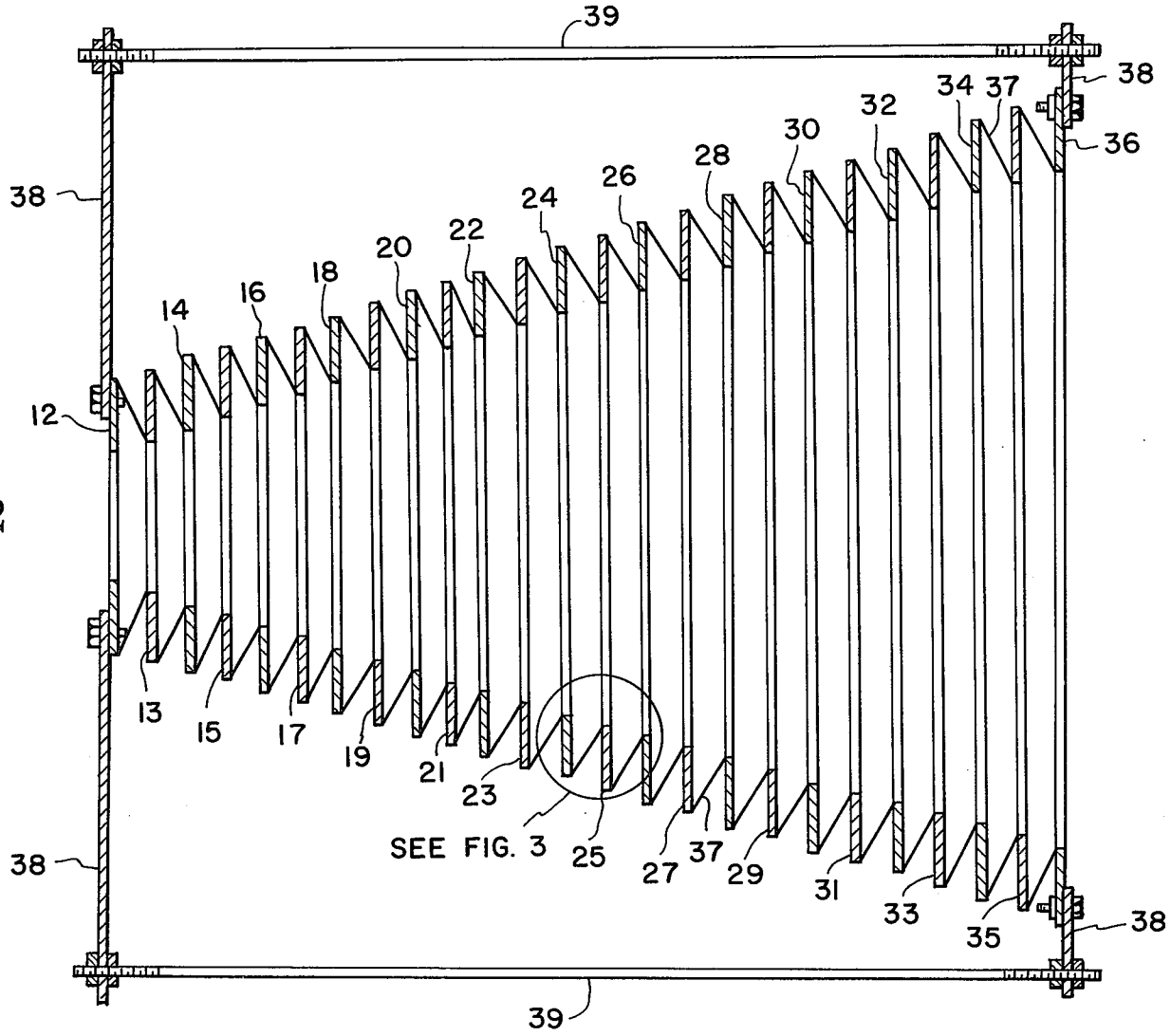
FIG. 2 is a cross sectional view 2—2 of the antenna shown in FIG. 1.

Turning now to the embodiment of the invention selected for illustration in FIGS. 1 and 2 of the drawings, the numbers 12-36 designate flat rigid metal annular rings having equal thicknesses. The metal in the rings can be any conductive metal; however, aluminum is a good selection because of its high conductivity and its light weight. The number of rings and their relative diameters are not critical and can vary depending upon the performance requirements imposed on the antenna. The annular rings 12-36 are arranged in a sequence so that ring 12, the smallest ring is first in the sequence, and each of the other rings is larger than the ring that precedes it in the sequence. A ring is designated as being larger than another ring if its outside dimensions are larger. A flexible electrically conductive member 37 made from a material such as, for example, aluminum mylar laminate attaches each pair of adjacent annular rings together physically and connects them together electrically. The number of electrically conductive members 37 is one less than the number of annular rings. The antenna is held in its extended position by any suitable means such as, for example, plates 38 and rods 39. These can be removed for shipment or storage.

Figure 3:
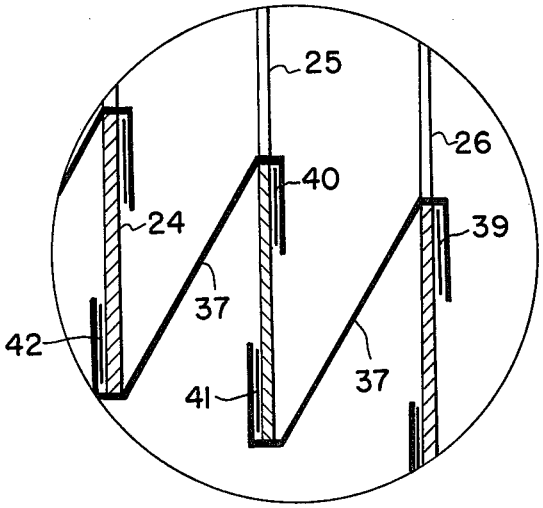
FIG. 3 is an enlarged view of a portion of FIG. 2.
Figure 4:
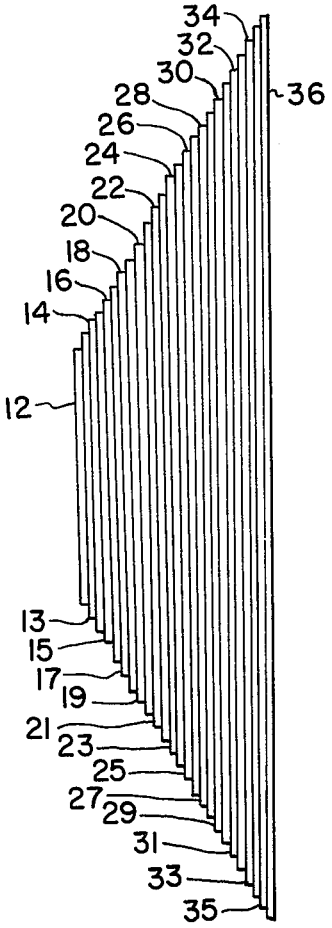
FIG. 4 is a side view of the antenna shown in FIGS. 1 and 2 in its collapsed state.

In FIG. 3 an enlarged view of annular rings 24, 25 and 26 is shown. The electrically conductive members 37 are cut to the proper shape and sizes to fit the adjacent annular rings around their entire inside and outside circumferences. That is, the conductive member 37 that attaches annular rings 24 and 25 together is cut and formed into a shape like the frustum of a cone with the bottom or outside circumference of member 37 folded around the outside circumference of ring 24 and with the top or inside circumference of member 37 folded around the inside circumference or ring 25. Likewise the member 37 that attached rings 25 and 26 together is cut and formed to fold around the outside circumference of ring 25 and the inside circumference of ring 26. An adhesive capable of conducting electricity is placed in regions 39, 40, 41 and 42 as illustrated in FIG. 3. Hence, each adjacent pair of annular rings is attached together physically and connected together electrically by a conductive member 37. Once the assembly has been completed, rings 12 through 36 and conductive members 37 form an unbroken conductive surface extending from ring 12 to ring 36. When collapsed, the antenna appears as shown in FIG. 4.

Figure 5:
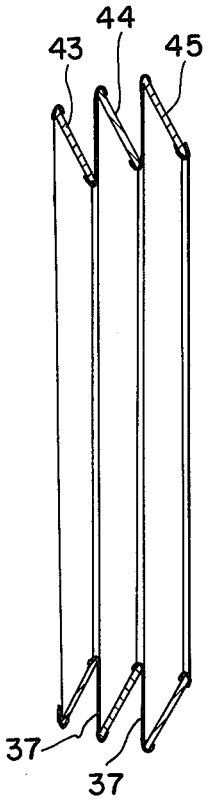
FIG. 5 is a side view of an alternate embodiment of the invention.

An alternate embodiment of the invention is shown partially in FIG. 5. In this embodiment each of the thin rigid annular metal rings 43, 44 and 45 (many more than three rings would probably be used to make an antenna) is shaped to form the frustum of a cone. The flexible electrically conductive members 37 are attached to the inside circumference of one of the rings and to the outside circumference of the succeeding ring in the sequence. When the embodiment shown in FIG. 5 is collapsed each of the rings will fit inside the ring that succeeds it in the sequence.

Although the invention has been described as being constructed with annular metal rings, it should be understood that other shapes can be used. For example, the shape of the rings could be rectangular, elliptic, etc., without departing from the invention.

What is claimed is:

1. A collapsible corrugated horn antenna comprising:

a plurality of rigid flat thin metal pieces with each piece having a hole in it the same shape as the holes in all other pieces but having a size different from the sizes of the holes in all other pieces;

said metal pieces arranged in a sequence such that the metal piece having the smallest hole is first and such that all other metal pieces has a hole larger than the hole in the metal piece that precedes it in the sequence; and a plurality of flexible electrically conductive members attaching successive metal pieces together physically and connecting them together electrically.

2. A collapsible corrugated horn antenna according to claim 1 wherein each of said flexible electrically conductive members is attached to make the electrical contact between the outside surface of a metal piece and the inside surface of an adjacent metal piece in the sequence.

3. A collapsible corrugated horn antenna according to claim 2 wherein said adjacent metal piece is the succeeding metal piece in said sequence.

4. A collapsible corrugated horn antenna according to claim 3 wherein each of said conductive members makes electrical contact completely around the inside and outside surfaces of the two adjacent metal pieces.

5. A collapsible corrugated horn antenna according to claim 4 wherein the outside surface of said antenna is continuous when it is in its extended position.

6. A collapsible corrugated horn antenna according to claim 1 wherein said flat thin metal pieces are flat annular rings.

7. A collapsible corrugated horn antenna according to claim 1 wherein each of said flat thin metal pieces is an annular ring shaped like the frustum of a cone.

8. A collapsible corrugated horn antenna according to claim 7 wherein each of said flexible electrically conductive members is attached to make electrical contact between the inside surface of an annular ring and the outside surface of the succeeding annular ring in said sequence.

* * * * *